US010385588B2

(12) United States Patent
Huang et al.

(10) Patent No.: US 10,385,588 B2
(45) Date of Patent: Aug. 20, 2019

(54) ELECTRIC LOCK AND CLUTCH MECHANISM THEREOF

(71) Applicant: TAIWAN FU HSING INDUSTRIAL CO., LTD., Kaohsiung (TW)

(72) Inventors: Lien-Hsi Huang, Kaohsiung (TW); Wen-Chieh Lee, Kaohsiung (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 0 days.

(21) Appl. No.: 15/844,652

(22) Filed: Dec. 18, 2017

(65) Prior Publication Data

US 2018/0320411 A1 Nov. 8, 2018

(30) Foreign Application Priority Data

May 4, 2017 (TW) ..... 106114725 A

(51) Int. Cl.

| | |
|---|---|
| ***E05B 47/00*** | (2006.01) |
| ***E05B 47/06*** | (2006.01) |
| ***E05B 1/00*** | (2006.01) |
| ***G07C 9/00*** | (2006.01) |

(52) U.S. Cl.

CPC ..... *E05B 47/0012* (2013.01); *E05B 1/0007* (2013.01); *E05B 47/068* (2013.01); *G07C 9/00896* (2013.01); *G07C 9/00944* (2013.01); *E05B 2047/0017* (2013.01); *E05B 2047/0021* (2013.01); *E05B 2047/0026* (2013.01); *E05B 2047/0084* (2013.01); *G07C 9/0069* (2013.01)

(58) Field of Classification Search

CPC .. E05B 47/0012; E05B 47/068; E05B 1/0007; E05B 2047/0026;

(Continued)

(56) References Cited

U.S. PATENT DOCUMENTS 4,854,143 A * 8/1989 Corder ..... E05B 47/068 70/218
7,770,423 B2 * 8/2010 Wu ..... E05B 47/0012 292/142
7,827,837 B2 * 11/2010 Huang ..... E05B 47/068 70/149

(Continued)

FOREIGN PATENT DOCUMENTS

CN 2536712 Y 2/2003
CN 101555744 A 10/2009

(Continued)

*Primary Examiner* — Lloyd A Gall
(74) *Attorney, Agent, or Firm* — Winston Hsu

(57) ABSTRACT

An electric lock includes a base, a driving module, a handle and a clutch member. The base has a first inclined surface. The driving module includes a driving member rotatable relative to the base and having a second inclined surface abutting against the first inclined surface, and a motor configured to drive the driving member to rotate. The handle is rotatably mounted to the base, and has a plurality of pushing structures. The clutch member includes a main body abutting against the driving member, and a pushed structure formed on the main body. Wherein, when the motor drives the driving member to rotate relative to the base along a first rotating direction, the driving member pushes the clutch member to move toward the handle, such that the pushing structure is configured to abut against the pushed structure to push the clutch member to rotate when the handle is rotated.

13 Claims, 10 Drawing Sheets

(58) Field of Classification Search
CPC ..... E05B 2047/0021; E05B 2047/0084; E05B 2047/0017; E05B 2047/0028; E05B 2047/003; E05B 2047/0031; E05B 2047/0085; G07C 9/00944; G07C 9/0069; G07C 9/00896
USPC .. 70/277, 278.1, 278.2, 278.3, 278.7, 279.1, 70/280–283, 283.1, 149, 422, 472, 218, 70/222, 223, 188–190; 292/142, 144, 292/DIG. 27
See application file for complete search history.

(56) References Cited

U.S. PATENT DOCUMENTS

| | | | | |
|---|---|---|---|---|
| 7,963,134 | B2 | 6/2011 | Rafferty | |
| 8,365,561 | B2 * | 2/2013 | Chang | E05B 47/02 292/142 |
| 9,051,761 | B2 * | 6/2015 | Romero | E05B 37/00 |
| 9,303,433 | B2 * | 4/2016 | Chiou | E05B 49/00 |
| 2004/0177660 | A1 * | 9/2004 | Tsai | E05B 47/068 70/223 |
| 2004/0207214 | A1 | 10/2004 | Lin | |
| 2009/0211320 | A1 * | 8/2009 | Wu | E05B 47/0012 70/277 |
| 2009/0229328 | A1 * | 9/2009 | Wu | E05B 47/0012 70/277 |
| 2018/0135335 | A1 * | 5/2018 | Huang | E05B 47/0012 |
| 2018/0266146 | A1 * | 9/2018 | Huang | E05B 47/0012 |

FOREIGN PATENT DOCUMENTS

| | | |
|---|---|---|
| CN | 103184813 A | 7/2013 |
| CN | 104790728 A | 7/2015 |
| CN | 205370156 U | 7/2016 |
| TW | I220912 | 9/2004 |
| TW | I335374 | 1/2011 |

* cited by examiner

ELECTRIC LOCK AND CLUTCH MECHANISM THEREOF

BACKGROUND OF THE INVENTION

1. Field of the Invention

The present invention relates to an electric lock, and more particularly, to an electric lock having a clutch mechanism which is simple and easy to assemble.

2. Description of the Prior Art

Generally, an electric lock utilizes a motor as a power source, and transmits a torsion torque outputted by the motor via a gear set, so as to drive a clutch mechanism of the electric lock to engage with or disengage from a latch assembly. When the gear set is driven by the motor to rotate forwardly, a pushed structure on the gear set can drive the clutch mechanism to engage with the latch assembly of the electric lock. Accordingly, a torsion torque exerted by a handle can be transmitted to the latch assembly, so that a user can open the door by rotating the handle. When the gear set is driven by the motor to rotate reversely, a spring can drive the clutch mechanism to disengage from the latch assembly of the electric lock. Thus, the torsion torque exerted by the handle cannot be transmitted to the latch assembly, so that the latch assembly can keep in a locked status. However, the clutch mechanism and the gear set of the electronic lock of the prior art have complex structures and are not easy to assemble. Therefore, the electric lock of the prior art has higher production cost and lower production efficiency.

SUMMARY OF THE INVENTION

The present invention provides an electric lock comprising a base, a driving module, a handle and a clutch member. The base has a first inclined surface. The driving module is arranged on the base. The driving module comprises a driving member and a motor. The driving member is rotatable relative to the base, and the driving member has a second inclined surface abutting against the first inclined surface. The motor is configured to drive the driving member to rotate. The handle is rotatably mounted to the base. The handle has a plurality of pushing structures. The clutch member comprises a main body abutting against the driving member, and a pushed structure formed on the main body. Wherein, when the motor drives the driving member to rotate relative to the base along a first rotating direction, the driving member pushes the clutch member to move toward the handle, such that the pushing structure is configured to abut against the pushed structure to push the clutch member to rotate when the handle is rotated.

The present invention further provides a clutch mechanism of an electric lock. The clutch mechanism comprises a clutch member and a driving module. The clutch member comprises a main body and a pushed structure formed on the main body. The driving module is configured to be arranged on a base having a first inclined surface. The driving module comprises a driving member and a motor. The driving member is rotatable relative to the base, and the driving member has a second inclined surface configured to abut against the first inclined surface. The motor is configured to drive the driving member to rotate. Wherein, when the motor drives the driving member to rotate relative to the base along a first rotating direction, the driving member pushes the clutch member to move away from the base.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
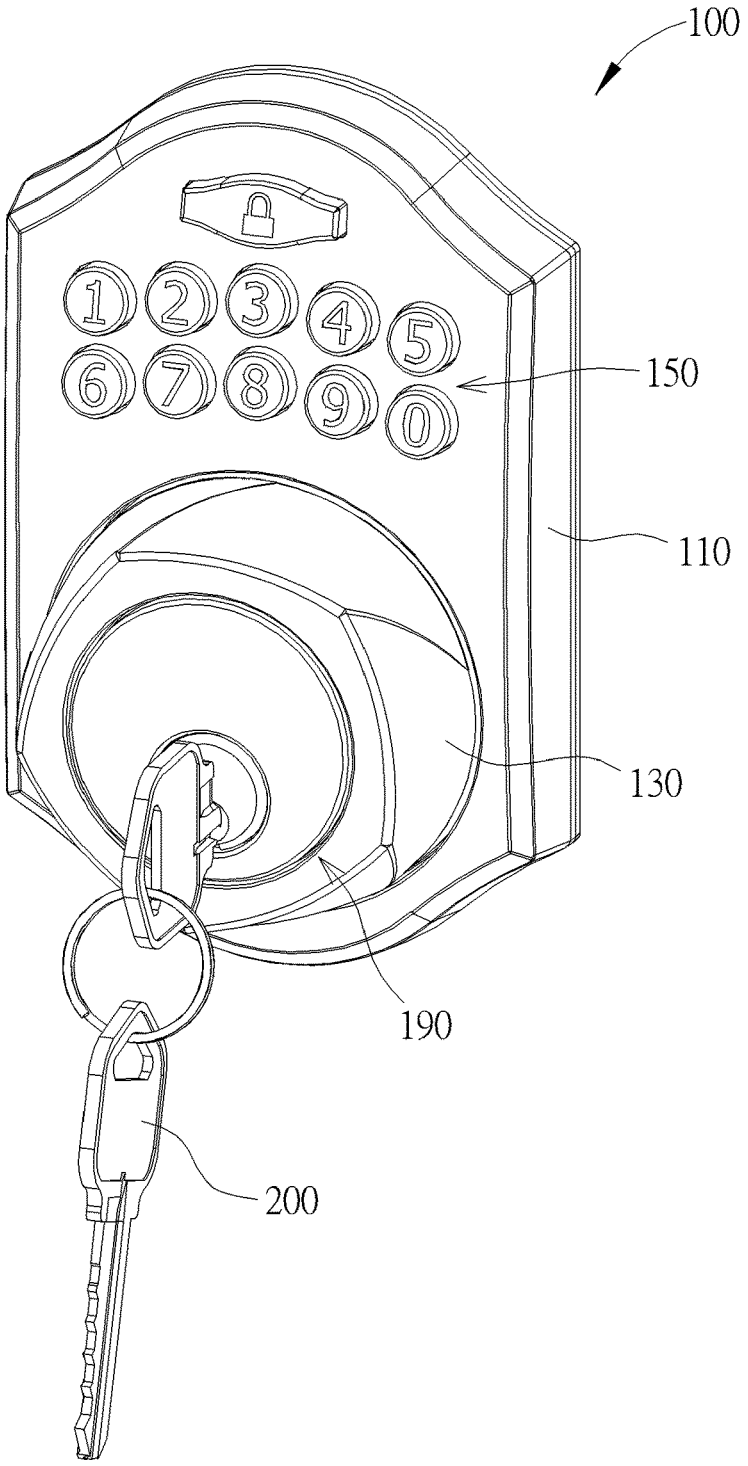
FIG. 1 is a diagram showing an electric lock of the present invention.
Figure 2:
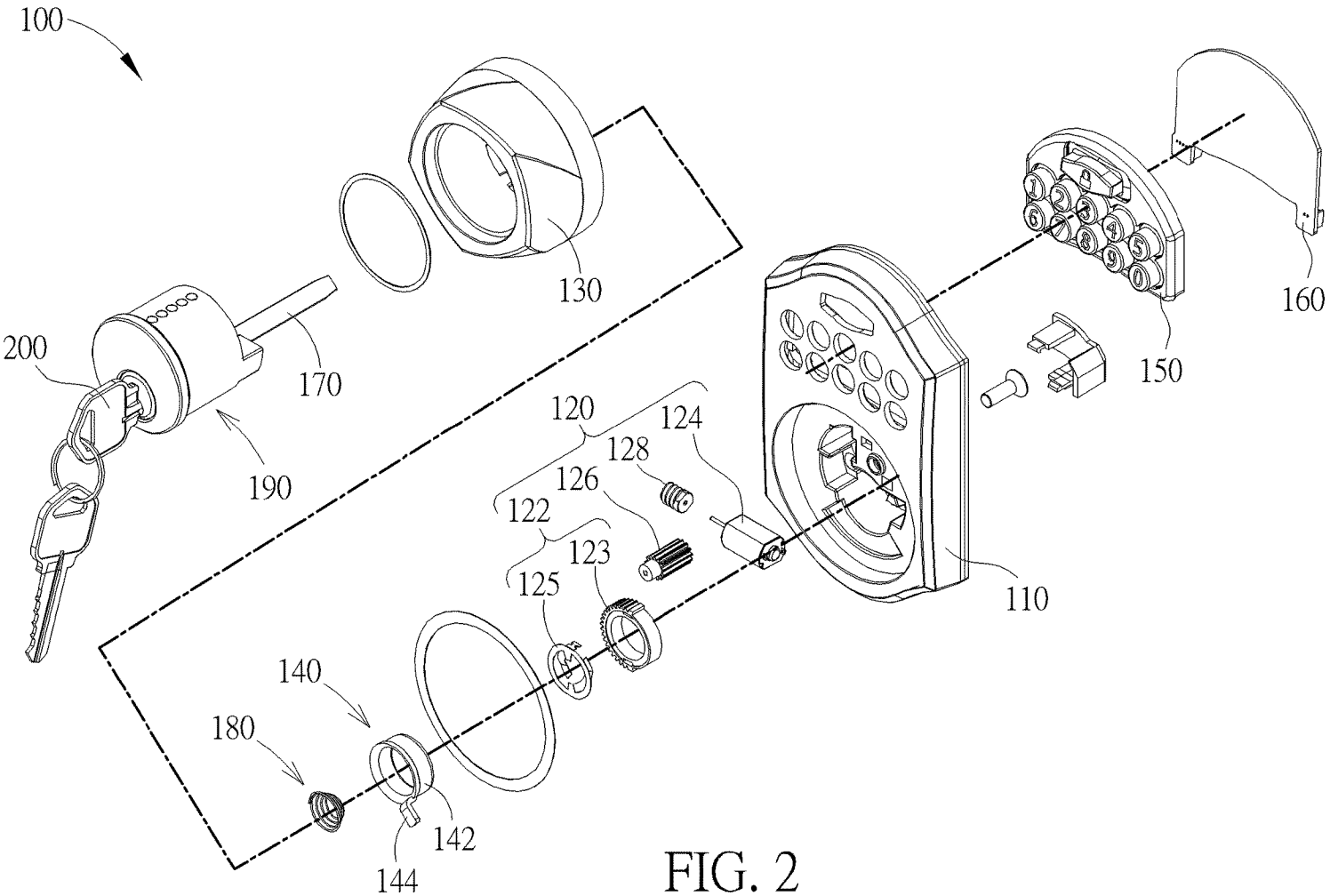
FIG. 2 is an exploded view of the electric lock of the present invention.

Please refer to FIG. 1 and FIG. 2 together. FIG. 1 is a diagram showing an electric lock of the present invention. FIG. 2 is an exploded view of the electric lock of the present invention. As shown in figures, the electric lock 100 of the present invention comprises a base 110, a driving module 120, a handle 130, a clutch member 140, an input interface 150 and a control unit 160. The electric lock 100 of the present invention can be fixed to a door for controlling movement of a latch on the door. The driving module 120 is arranged on the base 110. The driving module 120 comprises a driving member 122, a motor 124, a first transmission member 126 and a second transmission member 128. The driving member 122 is rotatable relative to the base 110. The first transmission member 126 abuts against the driving member 122. A rotation axis of the first transmission member 126 is parallel to a rotation axis of the driving member 122. The second transmission member 128 is arranged between the first transmission member 126 and the motor 124 for transmitting power of the motor 124 to the first transmission member 126, in order to allow the first transmission member 126 to further transmit the power of the motor 124 to the driving member 122. A rotation axis of the second transmission member 128 is not parallel to the rotation axis of the driving member 122. The handle 130 is installed on the base 110 in a rotatable manner. In the present embodiment, the first transmission member 126 is a gear and the second transmission member 128 is a worm gear, but the present invention is not limited thereto. The clutch member 140 comprises a main body 142 and a pushed structure 144. The pushed structure 144 is formed on one end of the main body 142. The input interface 150 is configured to receive a set of input data. In the present embodiment, the input interface 150 is a numeric keyboard for receiving a password inputted by a user, but the present invention is not limited thereto. In other embodiments of the present invention, the input interface can be a touch panel or other type of input device. The control unit 160 is electrically connected to the input interface 150 and the motor 124 for controlling operation of the motor 124 when the set of input data matches a set of predetermined data. For example, when the password inputted by the user matches a predetermined password, the control unit 160 can control the motor 124 to drive related components of the electric lock 100 for controlling the electric lock 100 to be in an unlocked state (or a locked state).

In addition, the electric lock 100 of the present invention further comprises a transmission rod 170 configured to be connected to a latch (not shown in figures). When the transmission rod 170 is rotated, the transmission rod 170 is configured to drive the latch to move between an unlocked position and a locked position. The clutch member 140 is sleeved on the transmission rod 170. When the clutch member 140 is rotated, the clutch member 140 is configured to drive the transmission rod 170 to rotate, in order to further drive the latch to move . Moreover, the electric lock 100 of the present invention further comprises an elastic member 180 configured to push the main body 142 of the clutch member 140 away from the handle 130.

On the other hand, the electric lock 100 of the present invention further comprises a lock core 190 connected to the transmission rod 170. When the lock core 190 is driven by a key 200, the lock core 190 is configured to drive the transmission rod 170 to rotate, in order to further drive the latch to move. As such, when the electric lock 100 of the present invention loses power, the user can still use the key 200 to perform unlocking or locking operation.

Figure 3:
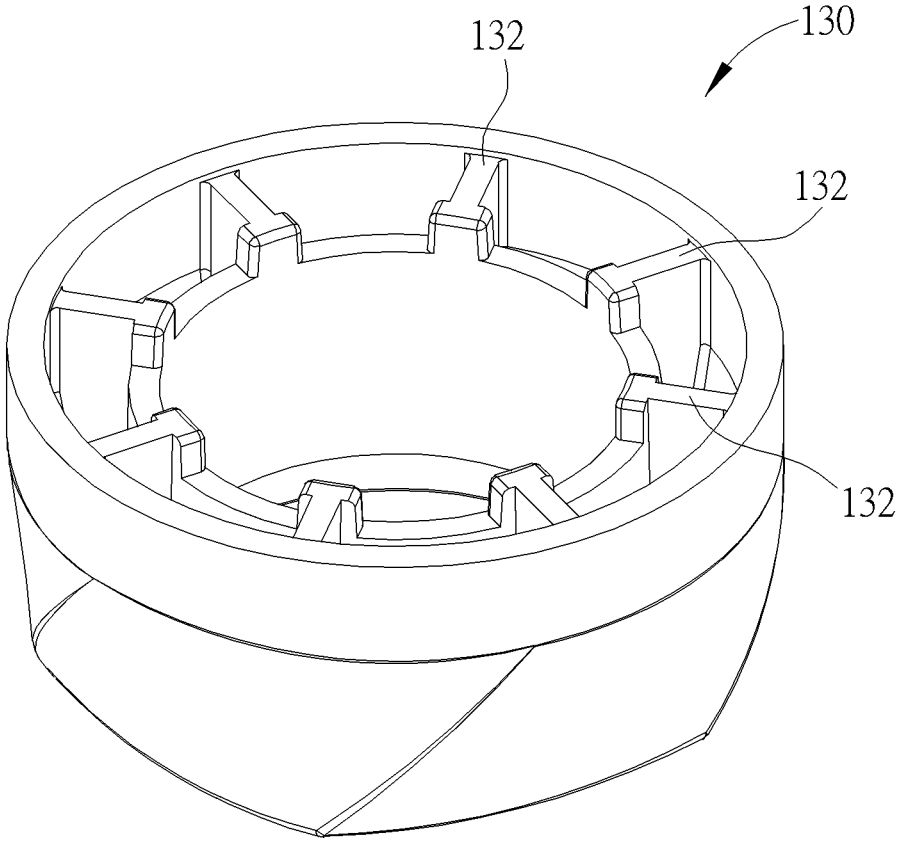
FIG. 3 is a diagram showing a handle of the electric lock of the present invention.

Please refer to FIG. 3. FIG. 3 is a diagram showing the handle of the electric lock of the present invention. As shown in FIG. 3, an inner periphery of the handle 130 of the present invention is formed with a plurality of pushing structures 132. In the present embodiment, the pushing structures 132 are protruded ribs, and a trough is formed between every two pushing structures 132. When the pushing structure 132 abuts against the pushed structure 144 of the clutch member 140, the handle 130 can be rotated for pushing the clutch member 140 to rotate.

Figure 4:
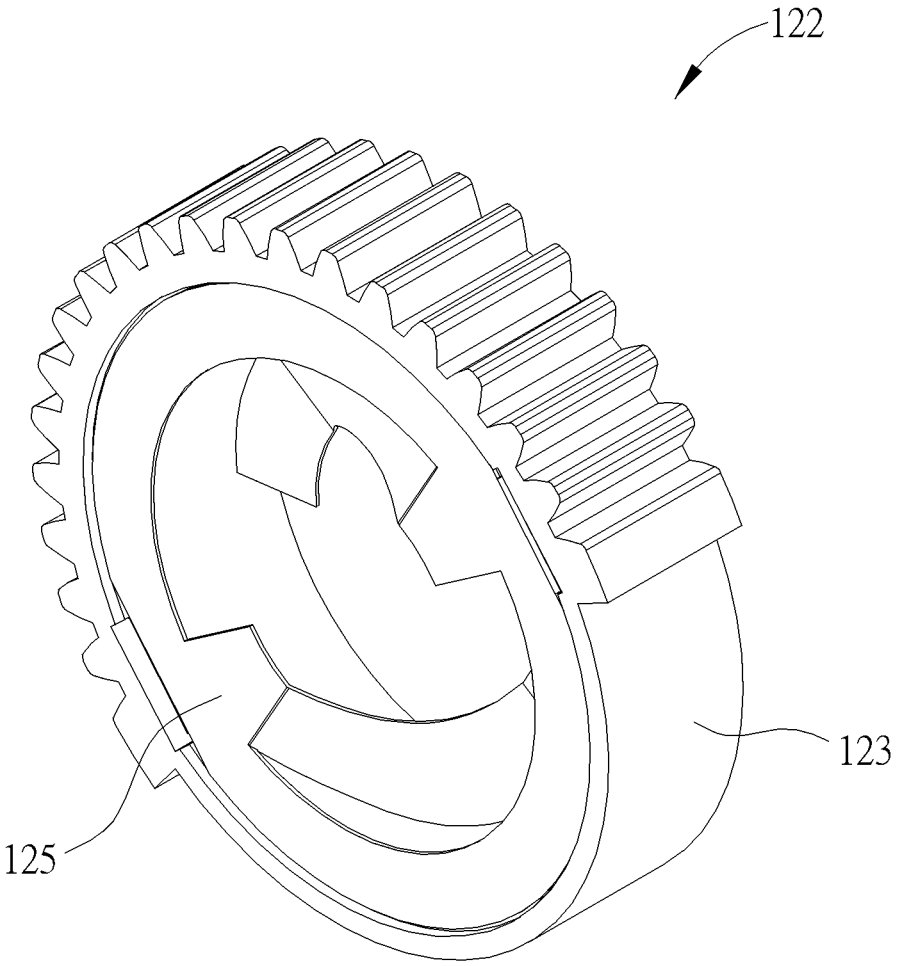
FIG. 4 is a diagram showing a driving member of the electric lock of the present invention.
Figure 5:
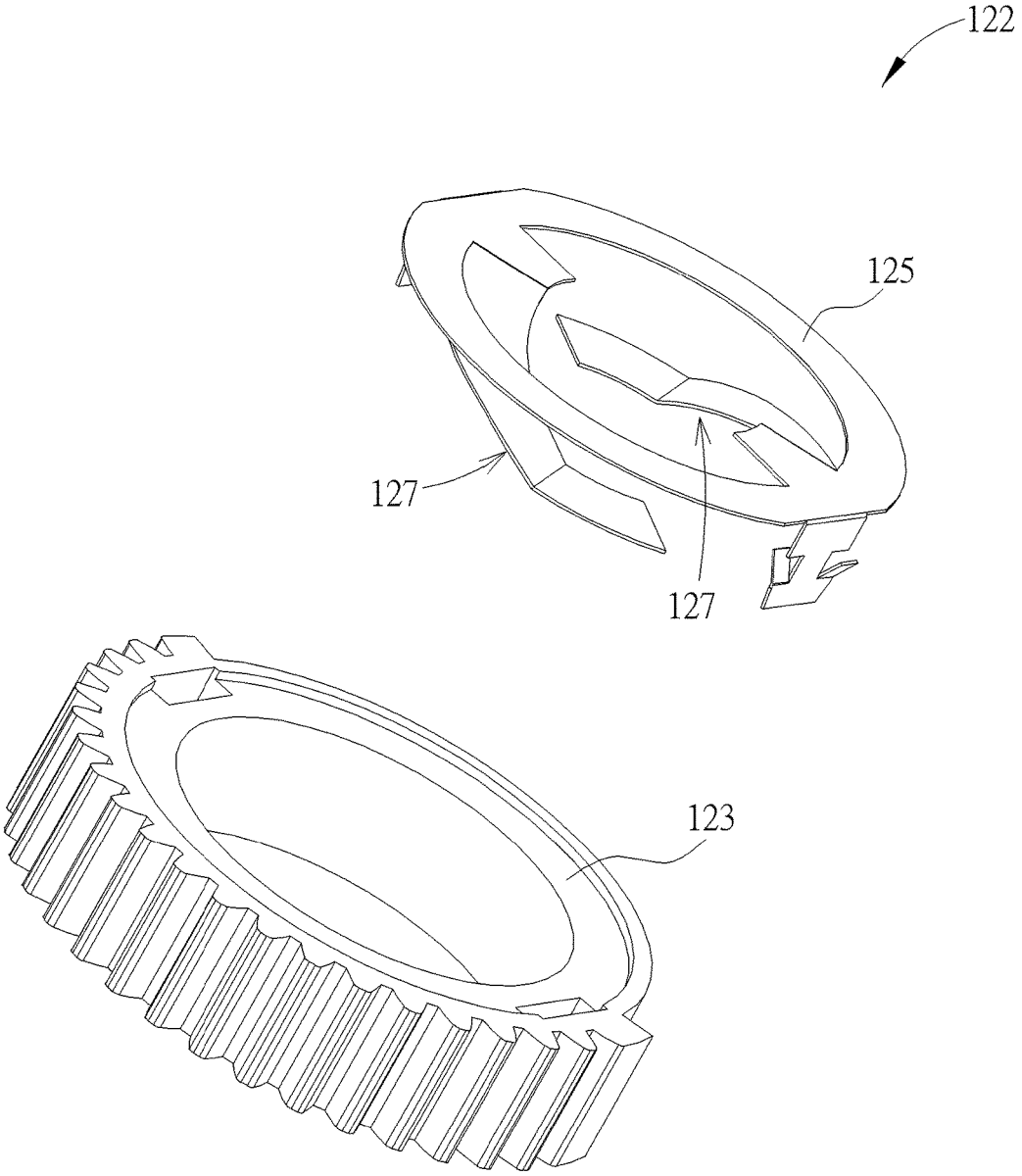
FIG. 5 is an exploded view of the driving member of the electric lock of the present invention.
Figure 6:
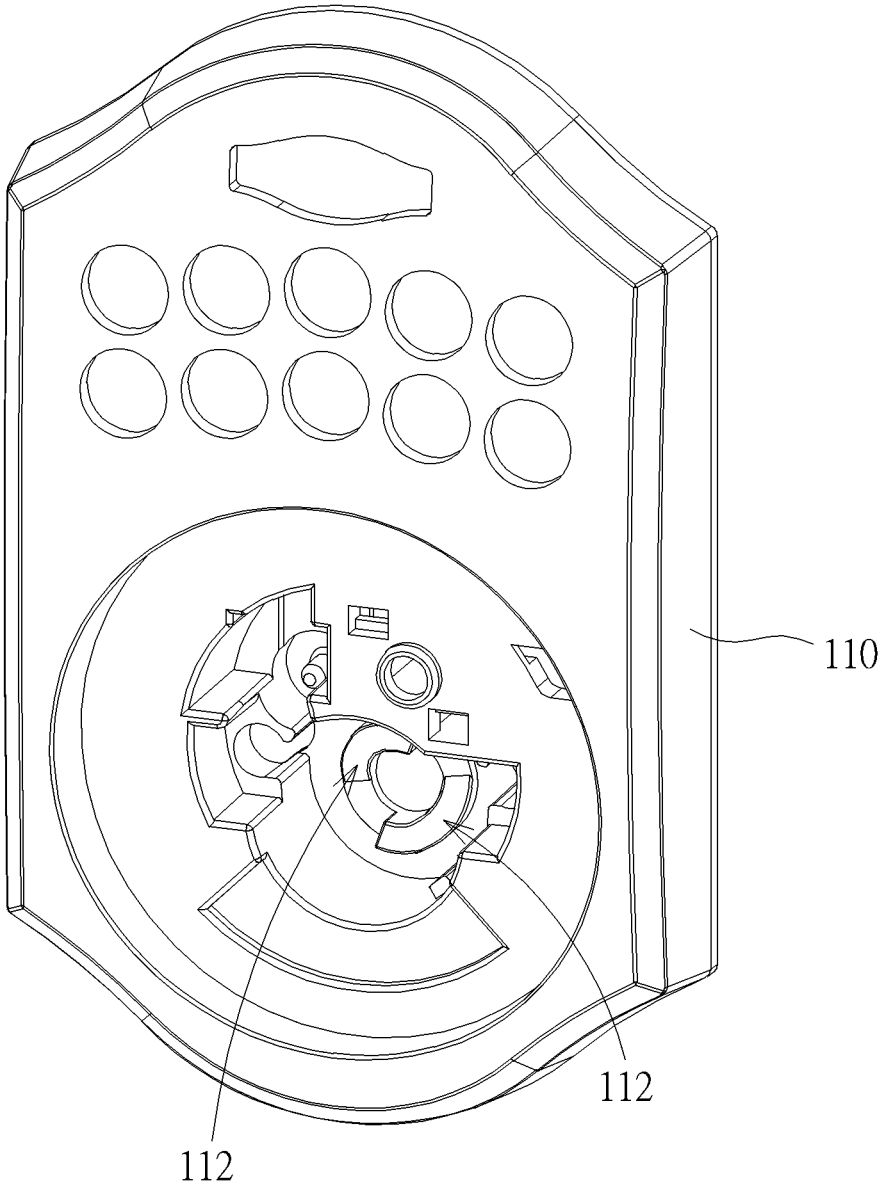
FIG. 6 is a diagram showing a base of the electric lock of the present invention.

Please refer to FIG. 4 to FIG. 6. FIG. 4 is a diagram showing the driving member of the electric lock of the present invention. FIG. 5 is an exploded view of the driving member of the electric lock of the present invention. FIG. 6 is a diagram showing the base of the electric lock of the present invention. As shown in figures, the driving member 122 of the present invention comprises a gear 123 and an elastic piece 125. The gear 123 is configured to be engaged with the first transmission member 126, in order to allow the motor 124 to drive the gear 123 to rotate via the first transmission member 126 and the second transmission member 128. The elastic piece 125 is arranged on the gear 123, and has at least one inclined surface 127. On the other hand, the base 110 has at least one inclined surface 112 corresponding to the inclined surface 127 of the elastic piece 125. The inclined surface 127 of the elastic piece 125 abuts against the inclined surface 112 of the base 110. When the motor 124 drives the gear 123 to rotate relative to the base 110 via the first transmission member 126 and the second transmission member 128, the inclined surface 127 of the elastic piece 125 is moved relative to the inclined surface 112 of the base 110, in order to allow the driving member 122 to move close to or away from the handle 130 along the rotation axis of the driving member 122.

Figure 7:
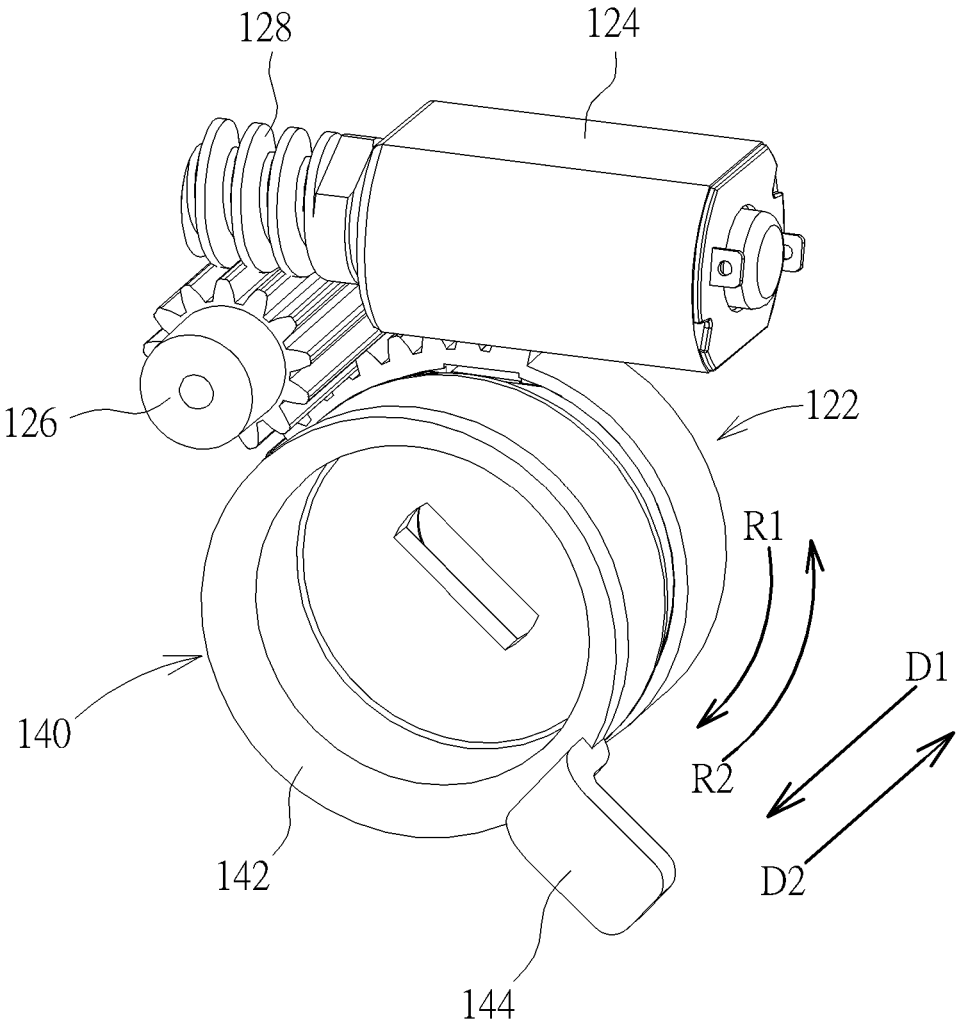
FIG. 7 is a diagram showing a clutch mechanism of the electric lock of the present invention.
Figure 8:
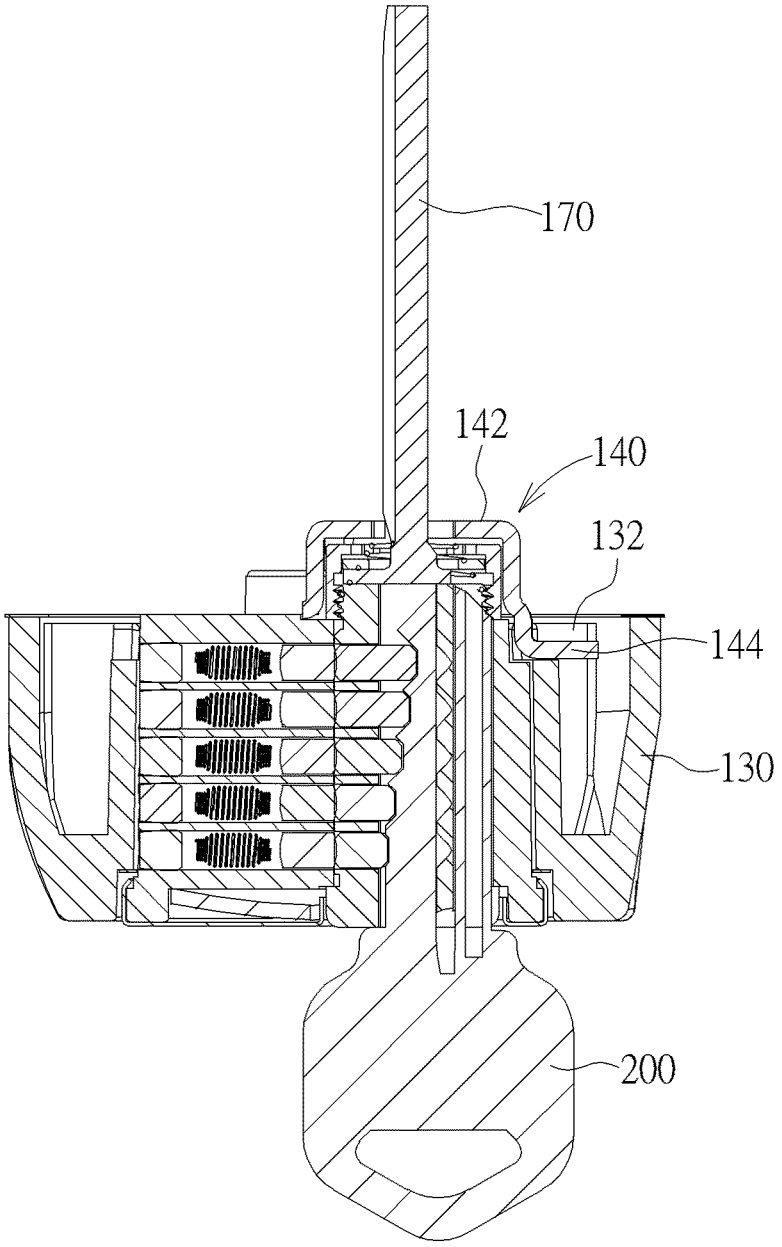
FIG. 8 is a diagram showing the electric lock of the present invention in an unlocked state.

Please refer to FIG. 7 and FIG. 8 together. FIG. 7 is a diagram showing a clutch mechanism of the electric lock of the present invention. FIG. 8 is a diagram showing the electric lock of the present invention in an unlocked state. As shown in figures, when the user controls the electric lock 100 to perform the unlocking operation via the input interface 150 (for example, a set of input data matches a set of predetermined unlocking data), the control unit 160 is configured to control the motor 124 to drive the driving member 122 to rotate relative to the base 110 along a first rotating direction R1. When the driving member 122 is rotated relative to the base 110 along the first rotating direction R1, the inclined surface 127 of the elastic piece 125 is moved upward relative to the inclined surface 112 of the base 110, in order to allow the driving member 122 to move close to the handle 130 along the rotation axis of the driving member 122 (along a first direction D1). In addition, the driving member 122 further pushes the main body 142 of the clutch member 140 to move close to the handle 130 (or away from the base 110), in order to allow the pushed structure 144 of the clutch member 140 to be located in the trough between the two pushing structures 132 of the handle 130. As such, when the user turns the handle 130, the pushing structure 132 is configured to abut against the pushed structure 144 to further drive the clutch member 140 to rotate. Accordingly, the transmission rod 170 is further driven to move the latch from the locked position to the unlocked position.

On the other hand, when the main body 142 of the clutch member 140 is moved close to the handle 130, and the pushed structure 144 of the clutch member 140 is moved to abut against a top end of the pushing structure 132 of the handle 130 without being located between the two pushing structures 132, the elastic piece 125 of the driving member 122 is pushed by the main body 142 of the clutch member 140 to allow the driving member 122 to be retracted toward the base 110. As such, interference between the driving member 122 and the clutch member 140 can be avoided. When the user further turns the handle 130, the pushed structure 144 of the clutch member 140 no longer abuts against the top end of the pushing structure 132 of the handle 130, and the elastic piece 125 of the driving member 122 pushes the driving member 122 and the clutch member 140 toward the handle 130 again, so as to allow the pushed structure 144 of the clutch member 140 to be located between the two pushing structures 132. As such, the user can turns the handle 130 to drive the latch to move from the locked position to the unlocked position via the clutch member 140 and the transmission rod 170.

Figure 9:
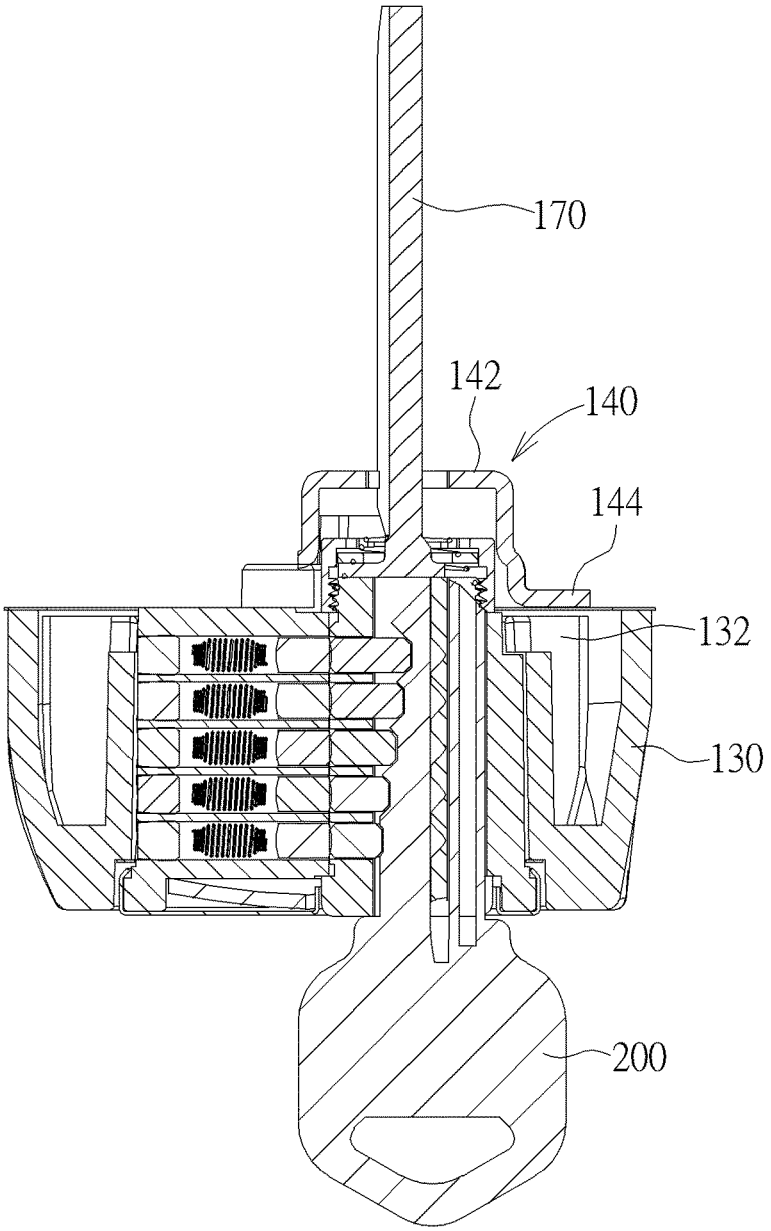
FIG. 9 is a diagram showing the electric lock of the present invention in a locked state.

Please refer to FIG. 7 and FIG. 9 together. FIG. 9 is a diagram showing the electric lock of the present invention in a locked state. As shown in figures, when the user controls the electric lock 100 to perform the locking operation via the input interface 150 (for example, a set of input data matches a set of predetermined locking data), the control unit 160 is configured to control the motor 124 to drive the driving member 122 to rotate relative to the base 110 along a second rotating direction R2. When the driving member 122 is rotated relative to the base 110 along the second rotating direction R2, the inclined surface 127 of the elastic piece 125 is moved downward relative to the inclined surface 112 of the base 110, in order to allow the driving member 122 to move away from the handle 130 along the rotation axis of the driving member 122 (along a second direction D2) . In addition, the elastic member 180 further pushes the main body 142 of the clutch member 140 to move away from the handle 130 (or close to the base 110), in order to allow the pushed structure 144 of the clutch member 140 to be no longer located in the trough between the two pushing structures 132 of the handle 130. As such, when the user turns the handle 130, the pushing structure 132 is not able to abut against the pushed structure 144 to further drive the clutch member 140 to rotate (that is, the handle 130 is merely rotated without working) . In other words, the transmission rod 170 is not driven by the clutch member 140 to move the latch from the locked position to the unlocked position.

Figure 10:
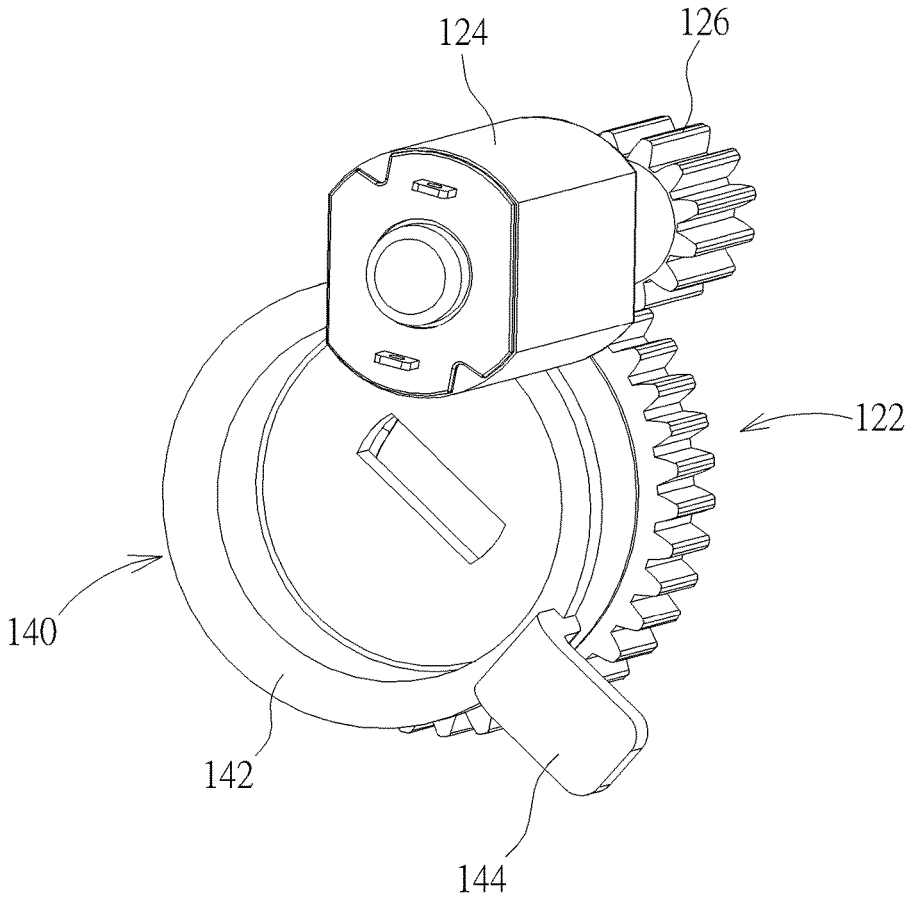
FIG. 10 is a diagram showing another embodiment of the clutch mechanism of the electric lock of the present invention.

Please refer to FIG. 10. FIG. 10 is a diagram showing another embodiment of the clutch mechanism of the electric lock of the present invention. As shown in FIG. 10, in another embodiment of the clutch mechanism of the electric lock of the present invention, the second transmission member 128 can be omitted. In other words, the motor 124 is directly connected to the first transmission member 126 to drive the driving member 122 to rotate relative to the base 110. Both a rotation axis of the motor 124 and the rotation axis of the first transmission member 126 are parallel to the rotation axis of the driving member 122. In the present embodiment, operations for controlling the electric lock to be in the locked state or the unlocked state are similar to those in the aforementioned embodiment (as shown in FIG. 8 and FIG. 9). Therefore, no further illustration is provided.

In contrast to the prior art, the clutch mechanism of the electric lock of the present invention utilizes the motor to drive the driving member to rotate, in order to allow the inclined surface of the driving member to move upward or move downward relative to the inclined surface of the base, so as to drive the clutch member to move close to or away from the handle for controlling the electric lock to be in the locked state or the unlocked state. The clutch mechanism of the electric lock of the present invention is simple and easy to assemble. Therefore, the present invention can reduce production cost and improve production efficiency.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electric lock, comprising:

a base having a first inclined surface;

a driving module arranged on the base, the driving module comprising:

a driving member comprising a gear and an elastic piece arranged on the gear, the elastic piece having a second inclined surface abutting against the first inclined surface, the driving member being rotatable relative to the base; and a motor configured to drive the driving member to rotate;

a handle rotatably mounted to the base, the handle having a plurality of pushing structures; and a clutch member, comprising:

a main body abutting against the driving member; and a pushed structure formed on the main body;

wherein when the motor drives the driving member to rotate relative to the base along a first rotating direction, the driving member pushes the clutch member to move toward the handle, such that one of the plurality of pushing structures is configured to abut against the pushed structure to push the clutch member to rotate when the handle is rotated.

2. The electric lock of claim 1, wherein when the motor drives the driving member to rotate relative to the base along a second rotating direction, the driving member and the clutch member are moved away from the handle, such that none of the plurality of pushing structures abuts against the pushed structure when the handle is rotated.

3. The electric lock of claim 1, wherein the driving module further comprises a first transmission member abutting against the driving member and configured to transmit power of the motor to the driving member, wherein a rotation axis of the first transmission member is parallel to a rotation axis of the driving member.

4. The electric lock of claim 3, wherein the driving module further comprises a second transmission member arranged between the first transmission member and the motor for transmitting power of the motor to the first transmission member, wherein a rotation axis of the second transmission member is not parallel to the rotation axis of the driving member.

5. The electric lock of claim 1, further comprising a transmission rod configured to be connected to a latch, wherein the transmission rod is driven to move the latch when the clutch member is rotated.

6. The electric lock of claim 5, wherein the clutch member is sleeved on the transmission rod.

7. The electric lock of claim 5, further comprising a lock core connected to the transmission rod for being driven by a key to further drive the transmission rod to move the latch.

8. The electric lock of claim 1, further comprising:

an input interface configured to receive a set of input data; and a control unit electrically connected to the input interface and the motor for controlling operation of the motor when the set of input data matches a set of predetermined data.

9. The electric lock of claim 1, further comprising an elastic member configured to push the main body of the clutch member away from the handle.

10. A clutch mechanism of an electric lock, comprising:

a clutch member, comprising:

a main body; and a pushed structure formed on the main body; and a driving module configured to be arranged on a base having a first inclined surface, the driving module comprising:

a driving member comprising a gear and an elastic piece arranged on the gear, the elastic piece having a second inclined surface abutting against the first inclined surface, the driving member being rotatable relative to the base; and a motor configured to drive the driving member to rotate;

wherein when the motor drives the driving member to rotate relative to the base along a first rotating direction, the driving member pushes the clutch member to move away from the base.

11. The clutch mechanism of claim 10, wherein when the motor drives the driving member to rotate relative to the base along a second rotating direction, the clutch member is moved toward the base.

12. The clutch mechanism of claim 10, wherein the driving module further comprises a first transmission member abutting against the driving member and configured to transmit power of the motor to the driving member, wherein a rotation axis of the first transmission member is parallel to a rotation axis of the driving member.

13. The clutch mechanism of claim 12, wherein the driving module further comprises a second transmission member arranged between the first transmission member and the motor for transmitting power of the motor to the first transmission member, wherein a rotation axis of the second transmission member is not parallel to the rotation axis of the driving member.

* * * * *